US005988932A

United States Patent [19]

Haney et al.

[11] Patent Number: 5,988,932

[45] Date of Patent: Nov. 23, 1999

[54] MARINE CONNECTOR

[75] Inventors: James Allan Haney, Houston; Trevor R. J. Mills, Katy; Chunfa Wu, Missouri City, all of Tex.

[73] Assignee: McDermott Technology, Inc., New Orleans, La.

[21] Appl. No.: 08/903,776

[22] Filed: Jul. 31, 1997

[51] Int. Cl.[6] ..... B25G 3/18

[52] U.S. Cl. ..... 403/321; 114/264; 114/242

[58] Field of Search ..... 403/13, 117, 113, 403/321, 150, 157, 161, 162, 322, 324; 114/261, 242, 249, 250, 252, 247, 246

[56] References Cited

U.S. PATENT DOCUMENTS 3,844,245 10/1974 Yamaguchi ..... 114/248

4,119,051 10/1978 Orndorff, Jr. ..... 114/249

5,439,310 8/1995 Evenson et al. ..... 403/321

*Primary Examiner*—Lynne A. Reichard

*Assistant Examiner*—David E. Bochna

*Attorney, Agent, or Firm*—Robert J. Edwards; D. Neil LaHaye

[57] ABSTRACT

A marine connector that facilitates docking of large floating objects during a sea state that produces significant relative motion between the two objects. A toggle nose is mounted on one floating object and a mating device, a toggle nose receiver, is mounted on the second floating object. The toggle nose contains a toggle mechanism that extends and retracts two opposed transverse pins having conical ends. The toggle nose receiver is provided with corresponding conical sockets to receive the ends of the pins.

12 Claims, 10 Drawing Sheets

MARINE CONNECTOR

BACKGROUND OF THE INVENTION

1. Field of the Invention

The invention is generally related to offshore vessels and more particularly to the connection and disconnection of large floating objects in the offshore environment during higher sea states.

2. General Background

Different types of operations in the offshore environment present the need for the connection and disconnection of large floating objects. However, accomplishing such operations presents unique and extreme engineering and operational needs.

Two floating objects in unprotected water will have significant relative motion in six degrees of freedom in the higher sea states. Means for connecting two or more floating objects can be designed to restrict relative motion of the two objects in one, or more, of the six degrees of freedom. The rotational degrees of freedom are yaw, roll, and pitch. Resisting relative yaw of the two objects produces bending in the horizontal plane, resisting relative roll produces torsion, and resisting relative pitch produces hogging and sagging. The moment produced by resisting each rotational degree of freedom must be developed by a couple produced by a pair of connectors. A couple produces its greatest resisting moment when its moment arm is greatest. Therefore, the connectors producing each couple should be spaced as far apart as possible. The translational degrees of freedom are sway, surge, and heave. Resisting relative sway of the two objects produces transverse loads on the connectors, resisting relative surge produces longitudinal load on the connectors, and resisting relative heave produces vertical load on the connectors.

The couple forces required to resist the rotational degrees of freedom are much greater than the forces required to resist the translational degrees of freedom. For large objects, the magnitude of the couple required to resist relative pitch is so great that the marine connector must be designed to release pitch. Connectors designed to resist relative roll and yaw must be placed as far outboard to port and starboard as possible, but also must be designed to release pitch. The roll and yaw connectors may also be used to resist the relative translational degrees of freedom.

FIG. 1 shows two floating objects 10 rigidly connected at the four corners, as indicated by numeral 12. Rigidly connected in this usage means that the connection is not compliant. Although the connectors are ideally located at the extremities, the couple required to prevent relative pitch will be too great for practical design.

The impinging sea state applies most of the loadings to the connected objects. Therefore, the loads applied to the connected objects and the loads induced in the connectors are primarily dynamic. In some applications, the dynamic response of the connected objects can be a problem. For instance, where several objects 10 are rigidly connected bow to stern, as shown in FIG. 3, torsion has a ratio between its first and second modes of about two. Thus, if the first torsional mode were twenty seconds, the second torsional mode would be about ten seconds. Bending in the horizontal plane has a slightly better ratio of about two point seven seconds. Thus, if the first horizontal plane bending mode were twenty-seven seconds, the second mode would be ten seconds. These ratios are too low to avoid resonance with waves in the high energy spectrum. To adequately straddle the periods of the high energy spectrum waves, a ratio between the first and second modes of about six is required. For instance, if a structure were contrived with a twenty-seven second first mode in torsion, its second torsional mode would be about four point five seconds. At this ratio, the first and second torsional modes fall above and below, respectively, the periods of the high energy spectrum waves.

If the objects are rigidly connected in the example given above, then the connectors and the structure supporting the connectors must be designed for the dynamically amplified loadings induced by the torsional and horizontal plane bending modes. The higher loadings will also make the fatigue problems worse. An optional design would be to substitute compliant connectors for the rigid connectors, thereby altering the dynamic response of the connected units favorably. A major consideration in this option is that the design load for the connector is equal to the maximum capacity of the compliant element, provided the compliant element is designed so that it never reaches the end of its stroke.

Another problem is that the two floating objects to be connected must be brought into close enough alignment for the connectors to engage. The alignment operation is called docking and must be facilitated with a docking system. If the relative motions for which the docking and connection systems are designed are exceeded then the operation will have to wait for the lower motions that will come when the seas moderate. The connectors and the structure supporting the connectors must be designed to resist the forces that are induced by the impinging sea state. If the connected objects encounter a large storm that continues to worsen, or some other emergency occurs, the objects may have to be disconnected while the connectors are resisting large loads. Therefore, the connectors must be designed with the capability to disconnect under load. Once disconnected, the floating objects will quickly develop the relative motions of two independently floating objects. Therefore, the connection and docking systems must facilitate quick separation of the two objects to prevent impact between features on the two objects.

Also, where more than one connector is used between the floating objects, the connectors must be synchronized so they all connect or disconnect simultaneously. Otherwise, damage will occur.

An example follows of the loads that are encountered when connecting floating objects. For five floating objects, each being one thousand feet long and five hundred feet wide, the magnitude of the design load for rigidly mounted connectors, port and starboard, varies from twenty thousand metric tons to about one hundred thousand metric tons. The magnitude of the design load for compliant connectors, port and starboard, ranges from five thousand metric tons to ten thousand metric tons. The connectors must be capable of releasing while these types of loads are active. The inventors are not aware of connectors that meet these requirements.

SUMMARY OF THE INVENTION

The invention addresses the above needs. What is provided is a marine connector that facilitates docking of large floating objects during a sea state that produces significant relative motion between the two objects. A toggle nose is mounted on one floating object and a mating device, a toggle nose receiver, is mounted on the second floating object. The toggle nose contains a toggle mechanism that extends and retracts two opposed transverse pins having conical ends. The toggle nose receiver is provided with corresponding conical sockets to receive the ends of the pins. Bevels on the toggle nose and receiver permit loose tolerance in yaw during the docking operation. Where the toggle nose and receivers are located both port and starboard, a central docking probe may be provided for additional guidance during the docking operation.

BRIEF DESCRIPTION OF THE DRAWINGS

For a further understanding of the nature and objects of the present invention reference should be had to the following description, taken in conjunction with the accompanying drawings in which like parts are given like reference numerals, and wherein.

DETAILED DESCRIPTION OF THE PREFERRED EMBODIMENT

Figure 1:
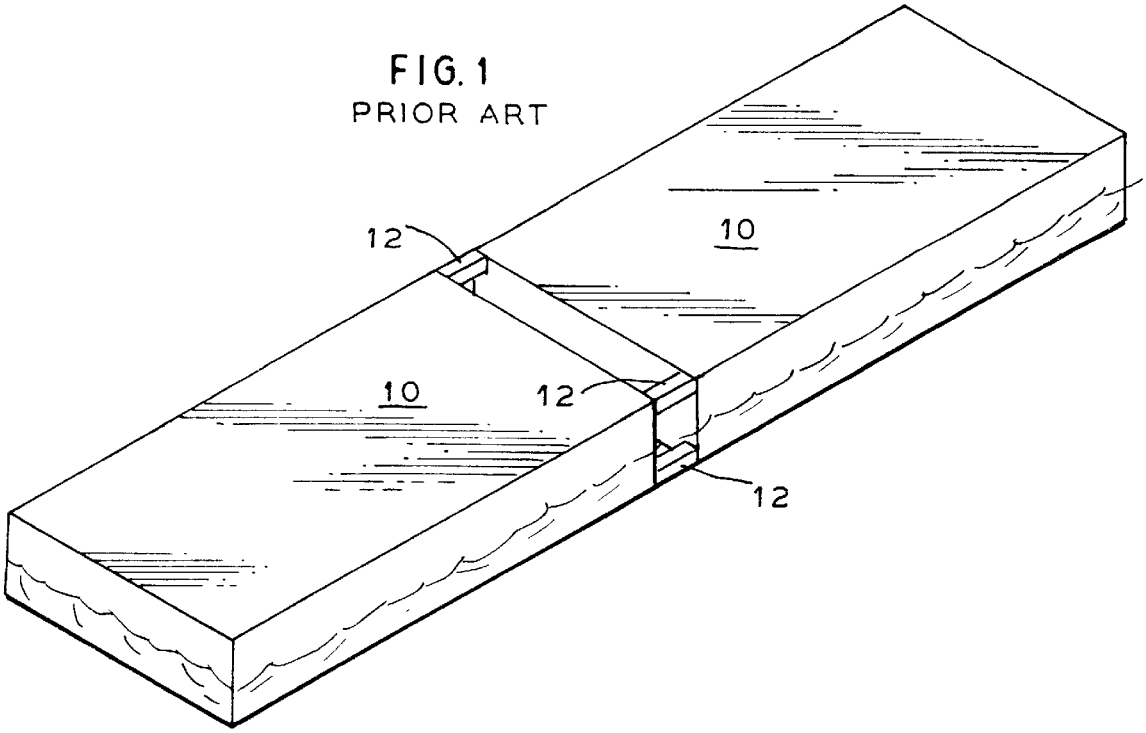
FIG. 1 PRIOR ART
FIG. 1 illustrates a prior art rigid connection.
Figure 2A:
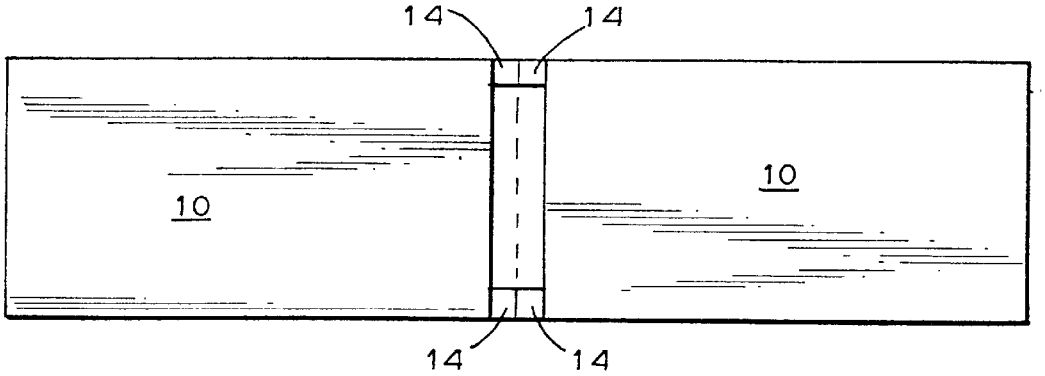
FIGS. 2A and 2B respectively are plan and elevation views illustrating frigid connection that releases relative pitch.
Figure 2B:
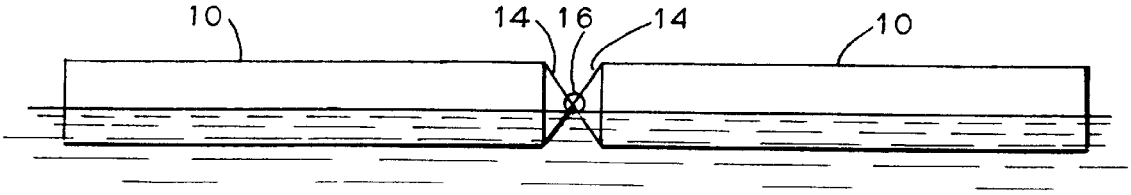
Figure 4:
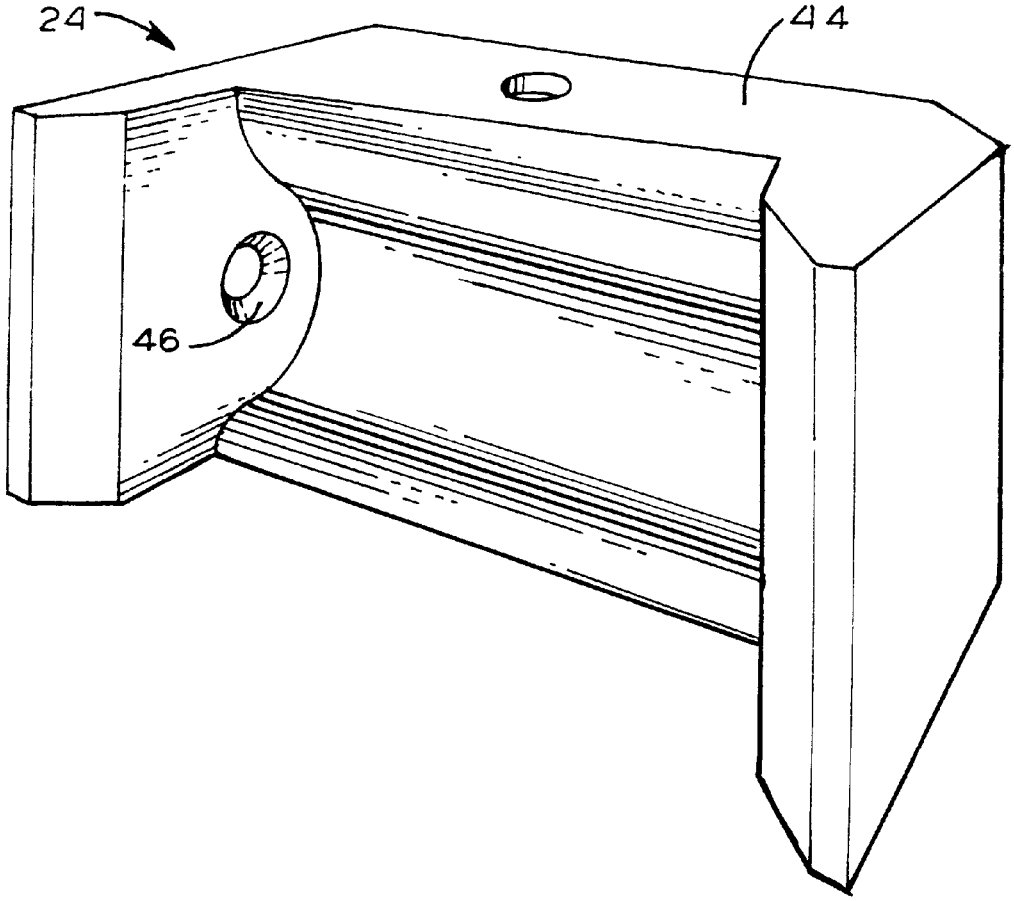
FIG. 4 is a perspective view of the toggle nose receiver of the invention.
Figure 5A:
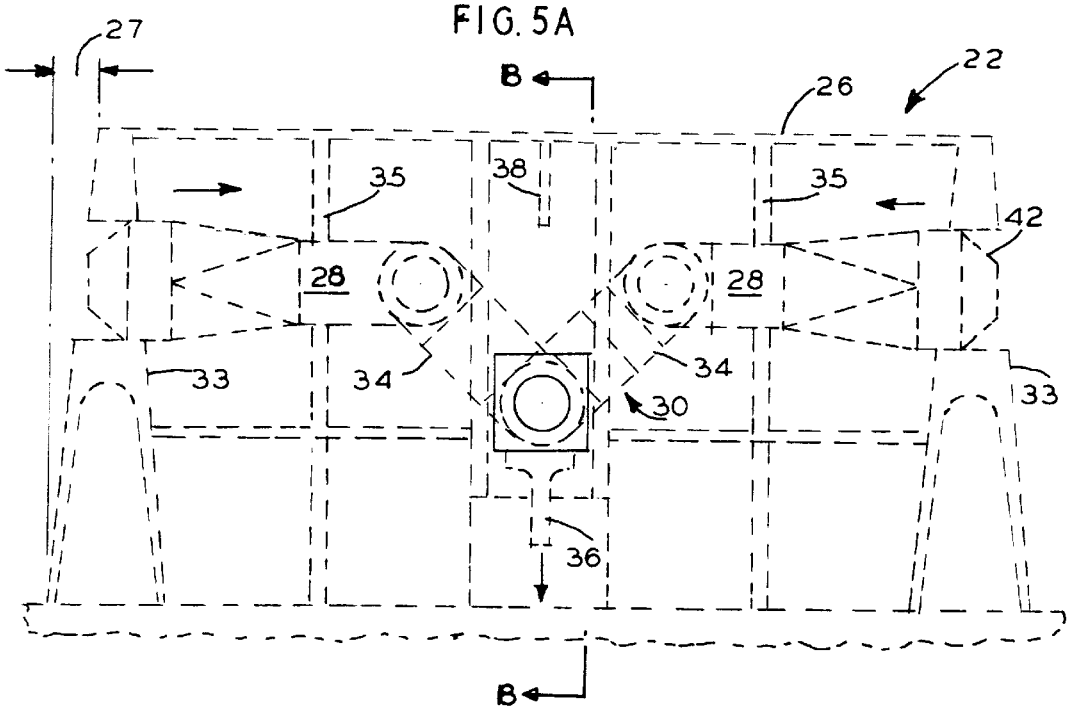
FIG. 5A is a plan cutaway view of the toggle nose of the invention with the transverse opposed pins in their retracted position.
Figure 5B:
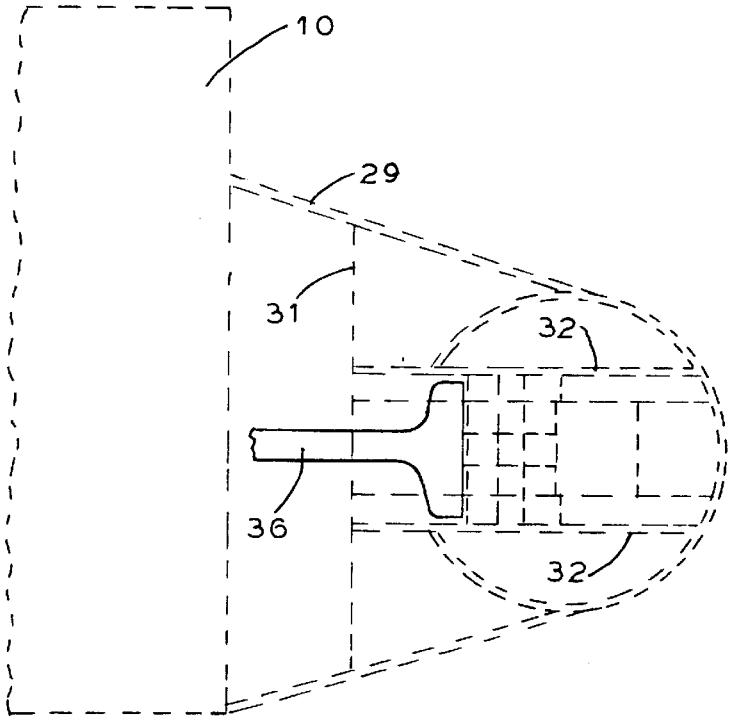
FIG. 5B is a view taken along lines B—B of FIG. 5A.

Referring to FIGS. 4 and 5, the marine connector of the invention is generally comprised of a toggle nose 22 and a toggle nose receiver 24. FIGS. 2A, B generally and schematically illustrate the concept of the invention where two floating objects 10 are rigidly connected by connectors 14 with transverse colinear pins 16. The transverse pins 16 release relative pitch, but resist relative yaw and roll, which requires that the pair of connectors 14 be located as far to port and starboard as possible.

Toggle nose 22, seen in FIGS. 5A,B and 6A,B, is comprised of a pipe 26, transverse pins 28, toggle mechanism 30 attached to the pins 28 for moving the pins 28 between a first retracted position and a second extended position, and bearings 33 and 35.

Figure 6A:
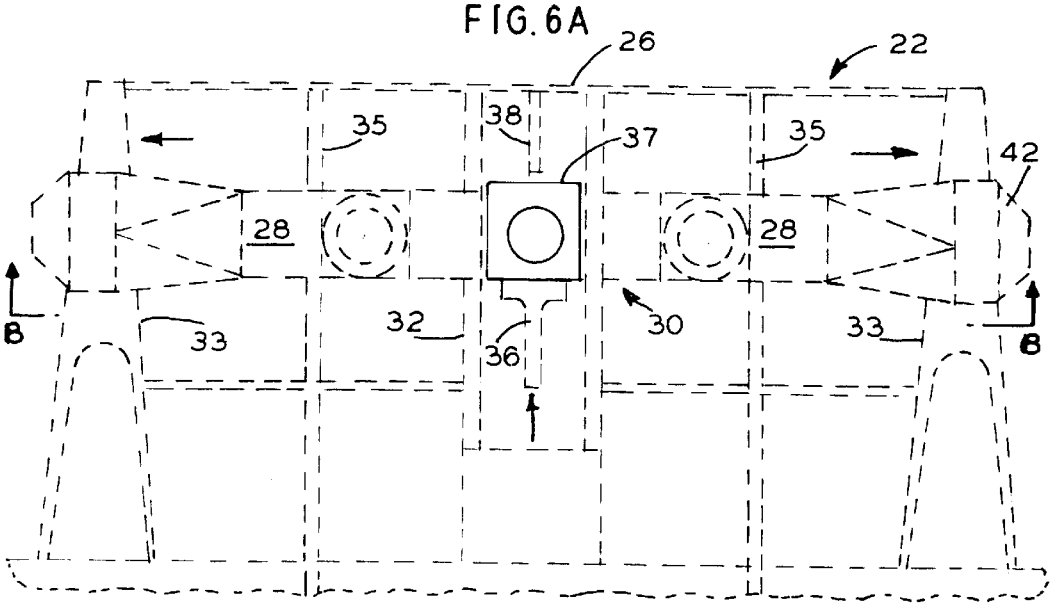
FIG. 6A is a plan cutaway view of the toggle nose of the invention with the transverse opposed pins in their extended position.
Figure 6B:
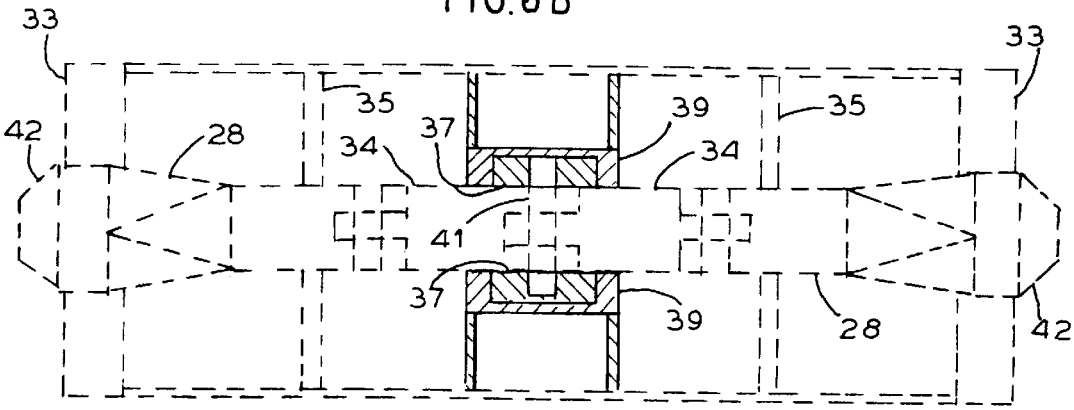
FIG. 6B is a view taken along lines B—B of FIG. 6A.

Pipe 26 is spaced apart from and rigidly attached to the floating object 10 by means of plates 29 and bearings 33 and 35. Internal plates 31 provide support to the assembly. Bearings 33, 35 slidably receive and provide support for transverse pins 28. A winged bearing 33 is rigidly attached at each end of pipe 26. As seen in FIG. 5A, winged bearing 33 is shaped to provide a bevel angle relative to floating object 10 as indicated at 27. A bearing 35 is positioned internally in pipe 26 on each side of toggle mechanism 30. The pipe provides a curved leading edge to toggle nose 22. The bevel and curved leading edge eliminate the need for perfect alignment with the toggle nose receiver 24 during docking operations. As seen in FIG. 6B, slide blocks 37 fit on the top and bottom ends of central pin 41 of toggle mechanism 30 where toggle joint arms 34 are pivotally attached to each other. U-shaped channels 39 are rigidly mounted in pipe 26 and form slides 32 that slidably receive blocks 37 for forward and reverse toggle motion, indicated by the arrows in FIGS. 5A and 6A, and also restrict side-to-side motion of the entire toggle mechanism 30 when loads are placed along the longitudinal axis of the pins 28. A stop 38 is provided in frame 26 directly in line with yoke 36 and is sized to a length such that the yoke 36 is allowed to move the toggle mechanism 30 only slightly beyond its center point as seen in FIG. 6A. The purpose of this will be explained below.

Pins 28 are attached on the ends of the arms 34 of the toggle mechanism and are slidably received in bearings 35 and bearings 33 on either end of the pipe 26 so as to be movable between a first retracted position (FIG. 5A) and a second extended position (FIG. 6A). The ends 42 of pins 28 are illustrated as being conical in the drawings. However, since a number of surfaces of revolution are suitable, the term conical should be taken as referring to any number of surfaces of revolution.

The conical ends 42 of the transverse pins 28 serve several functions.

When the toggle nose 22 is docked in the toggle nose receiver 24, there will still be relative motion between the floating objects 10, which will cause relative motion between the toggle nose and receiver. The diameters of the conical pin end and the conical socket are made large enough that the pin end will always engage the socket when the pins are extended, even with the maximum relative displacement of pin end and socket present. So the conical pin ends provide reliable connection between the floating objects, while these objects are moving relative to each other.

When the transverse pins are extended and seated in the sockets, the toggle nose is locked into its receiver. When any force acts to separate the nose and its receiver, the conical pin ends are pushed inward, which forces the toggle against its stop. So the conical pin end provides a passive, reliable lock.

To disconnect the toggle nose from the toggle nose receiver, an actuator (not shown) must push or pull the toggle mechanism off the stop and past center. Once the toggle mechanism is past center, it has no significant load carrying capacity. When the separation of the two floating objects reacts the conical socket against the conical pin ends, the pin ends are driven inward, which will collapse the toggle mechanism, if it has been previously pushed off its stop past center. So the conical pin ends provide an automatic disconnect feature.

The operational principle of toggle mechanism 30 is well known, with two arms 34 that are hinged together for pivoting motion and are each connected at their opposite ends to one end of transverse pins 34 such that movement of arms 34 by yoke 36 causes corresponding translational movement of transverse pins 28.

Figure 7:
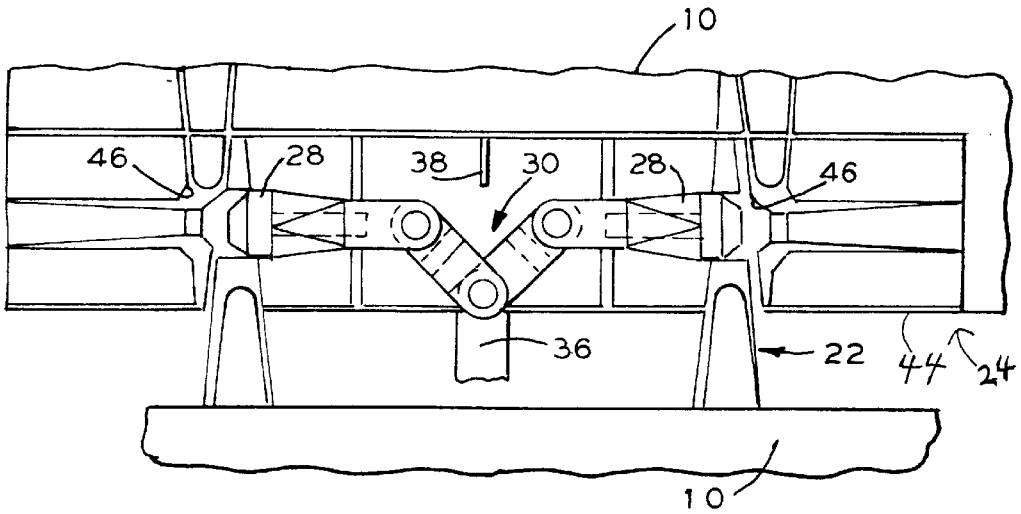
FIG. 7 is a horizontal section through the center line of the toggle nose seated in its receiver with the transverse pins retracted.
Figure 8:
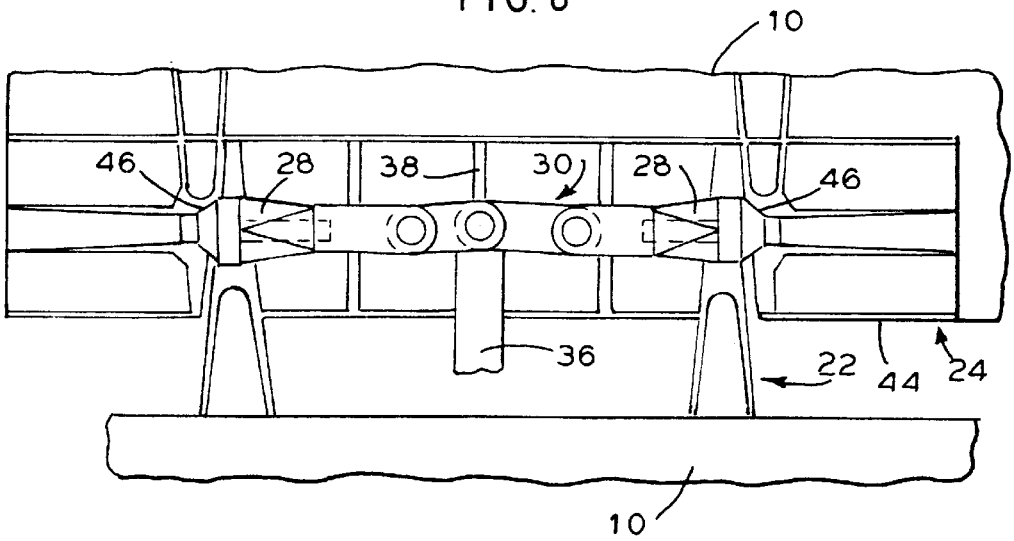
FIG. 8 is a horizontal section through the center line of the toggle nose seated in its receiver with the transverse pins extended.

Toggle nose receiver 24 is formed from a combined housing and support frame 44 (FIGS. 4, 7, and 8) that is formed so as to be integral with and rigidly attached to a second floating object 10. The sides of housing/support frame 44 are beveled at an angle that is complementary to the bevel of the toggle nose 22. The upper, lower, and rear edges are curved in a complementary shape to the leading edge curve of toggle nose 22. Sockets 46, one at each side, have a complementary shape and size to pin ends 42 so as to receive pins 28 when in their second extended position. FIG. 7 illustrates toggle nose 22 received in toggle nose receiver 24 with pins 28 in their first retracted position. FIG. 8 illustrates toggle nose 22 received in toggle nose receiver 24 with pins 28 in their second extended position and engaged in sockets 46. It can be seen in FIG. 8 that when pins 28 are fully engaged with sockets 46, that toggle nose 22 and toggle nose receiver 24 are sized such that there is no contact between the pipe 26 and housings/frame 44. The only point of contact is between the ends 42 of pins 28 and the surfaces of sockets 46 of housing/frame 44. Another feature of the relative sizing of toggle nose 22 and toggle nose receiver 24, and positioning of pins 28 and sockets 46 is that, during the docking operation, the leading edge of toggle nose 22 may be placed into full contact with the rearmost interior of toggle nose receiver 24 and the toggle mechanism 30 may still be operated to engage pins 28 in sockets 46. The conical shape of pin ends 42 and sockets 46 allow pins 28 to engage sockets 46 and force toggle nose 22 and toggle nose receiver 24 into the fully connected and locked, non-contact position shown in FIG. 8.

Once the conical pin ends 42 are seated in the sockets 46, any force tending to separate the toggle nose 22 from the toggle nose receiver 24 must be resisted in shear by the pins 28. The pins 28 will act against the sockets 46 in a direction normal to the axis of the pins 28 with a force equal to the shear load in the pins 28. In addition, the shear load on the pin 28 will induce an axial load in the pin 28 equal to the shear load, if the pin ends are forty-five degree cones. The pins 28 will push axially against the sockets 46 with a load equal to the shear load in the pins 28. The sockets 46 will deliver the axial pin load to the housing frame 44, which in turn will deliver the load to the tension bars 23 shown in FIG. 14. The tension bars 23 extend from the housing frame 44 on one side of the toggle nose receiver 24 to the housing frame 44 on the other side. Thus, the tension bars react the load in one side of the toggle nose receiver, against the load in the other side. For instance, suppose a longitudinal load of fifty thousand tons acts to separate a toggle nose 22 from its toggle nose receiver 24. A shear load of twenty-five thousand tons in each pin 28 would resist the longitudinal load. The shear loads on each pin end 42 would induce an axial load of twenty-five thousand tons in the pins 28 and toggle members 34. The twenty-five thousand ton pin load would react against the sockets 46 and would be transferred via the housing frames 44 to the tension bars 23. Top and bottom tension bars would each develop twelve thousand five hundred tons and react one side of the toggle nose receiver against the other.

In situations where a toggle nose 22 and toggle nose receiver 24 are used on both the port and starboard extremities of the ends being used to connect the floating objects, the use of a docking probe and receptacle may be beneficial during the docking operation. FIGS. 9A–F illustrate such a situation and also show the docking sequence and yaw tolerance provided by the invention. The corresponding ends of floating objects 10 are respectively provided with a docking probe 48 and docking receptacle 50.

Figure 9A:
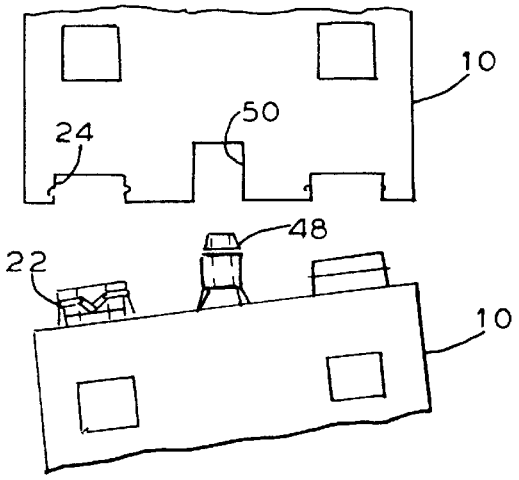
FIGS. 9A–F illustrate a plan view of the docking sequence between two floating objects using the invention.
Figure 9B:
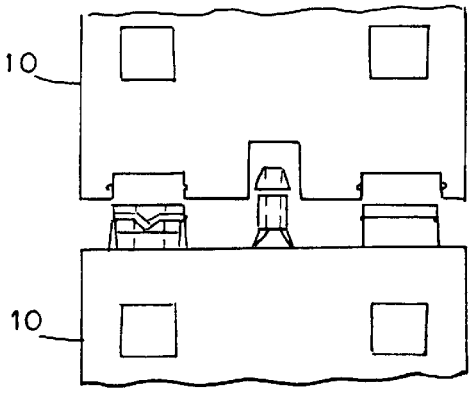
Figure 9C:
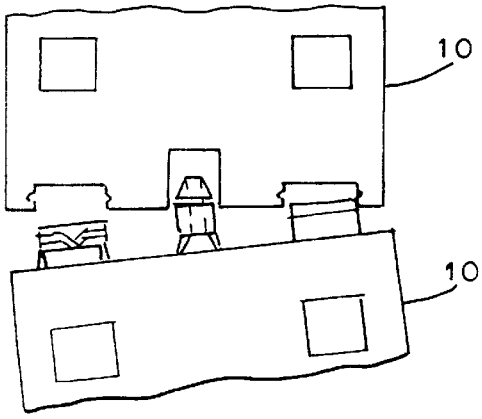
Figure 9D:
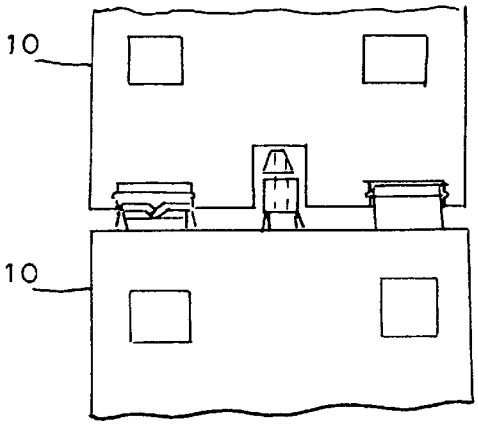
Figure 9E:
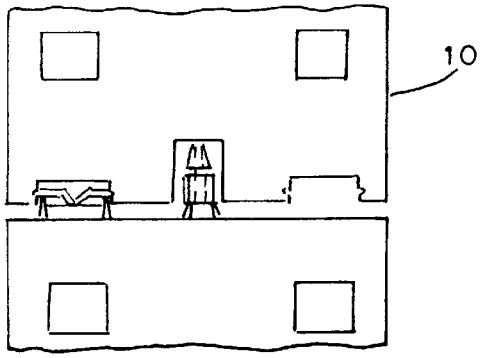
Figure 9F:
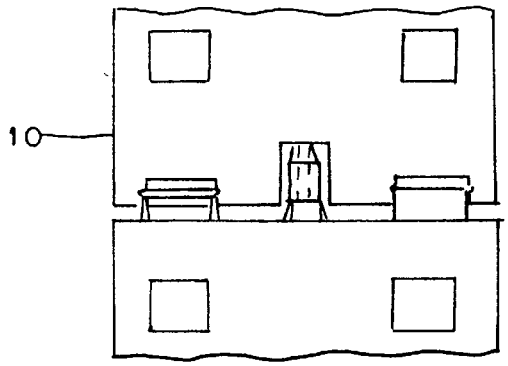

In operation, floating objects 10 are vertically aligned by ballasting to obtain the correct trim and draft. Positioning means such as anchoring systems or dynamic positioning systems are used to transversely align floating objects 10 and then force the ends toward each other, seen in FIG. 9A. When docking probe 48 engages receptacle 50 (FIG. 9B), floating objects 10 are forced into tight enough transverse alignment to start the engagement of toggle noses 22 and toggle nose receivers 24. FIG. 9C illustrates the yaw tolerance provided by the invention for engaging toggle nose 22 in toggle nose receiver 24 once docking probe 48 has been engaged with receptacle 50. FIG. 9D illustrates the yaw tolerance provided when both toggle noses 22 and toggle nose receivers 24 are engaged. FIG. 9E illustrates both toggle noses 22 and toggle nose receivers 24 fully seated. FIG. 9F illustrates the transverse pins 28 extended and the docking and connection operations completed.

Figure 10:
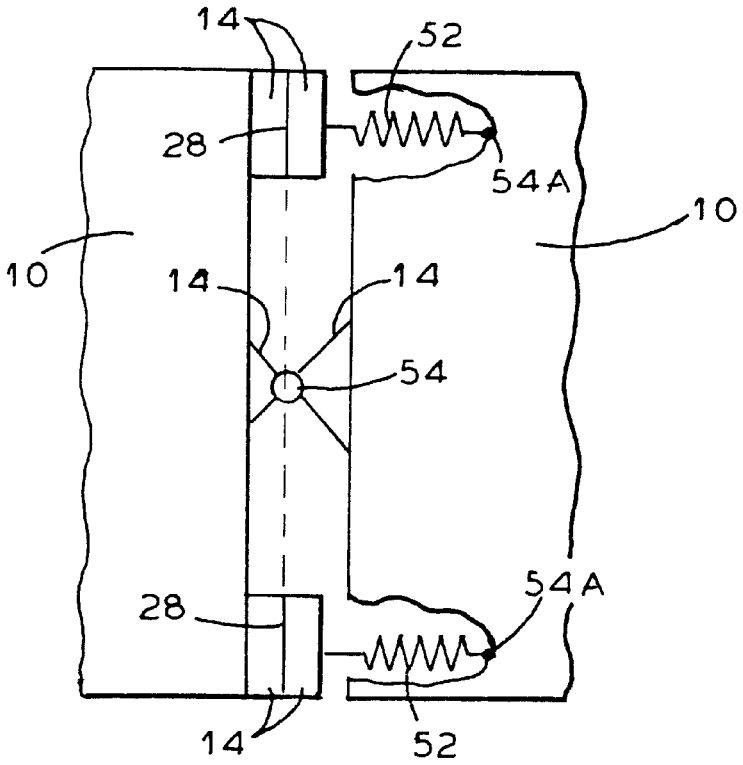
FIG. 10 is a schematic illustration of the use of a compliant element in conjunction with the invention.

FIG. 10 schematically illustrates the use of a compliant element 52 in conjunction with the invention. In this embodiment, a marine connector 14 as described above is provided with a universal connection, schematically illustrated and indicated by numeral 54. The universal joint 54 prevents relative translation of the floating objects 10 in sway, surge, and heave, but permits relative rotation of the floating objects 10 in yaw, roll, and pitch. The colinear transverse pins 28 on the port and starboard connectors 14 and the universal connection permit relative pitch of the floating objects 10. The compliant elements 52 offer resistance to extension and contraction. Therefore, the compliant elements 52 offer considerable resistance to relative yaw of the connected objects 10 and some resistance to relative roll. The compliant element 52 is attached at a first end to connector 14 and at a second to the floating object 10. The connection between the port and starboard compliant elements 52 and floating object 10 must be made using a universal joint, schematically indicated at 54A.

Figure 11:
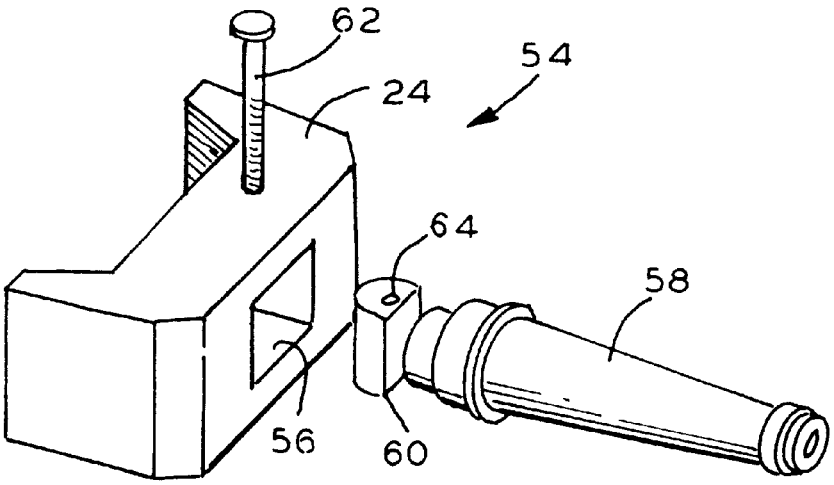
FIG. 11 illustrates a universal joint of the invention.

FIG. 11 illustrates the central universal joint 54. Toggle nose receiver 24 is provided with a bore 56. A longitudinal shaft 58 has a first end 60 sized to be received in bore 56. Vertical pin 62 is inserted in a bore in toggle nose receiver and through bore 64. Thus, the longitudinal shaft 58 cantilevers the toggle nose receiver 24 from the floating object 10 and permits rotation about the vertical axis. The remainder of longitudinal shaft 58 is rotatably attached to floating object 10, which allows the whole assembly (receiver 24 and shaft 58) to rotate about the shaft centerline. The transverse opposed pins in the toggle nose permit rotation about the transverse axis. Therefore, a universal joint is formed because rotation is permitted about three orthogonal axes.

Figure 12:
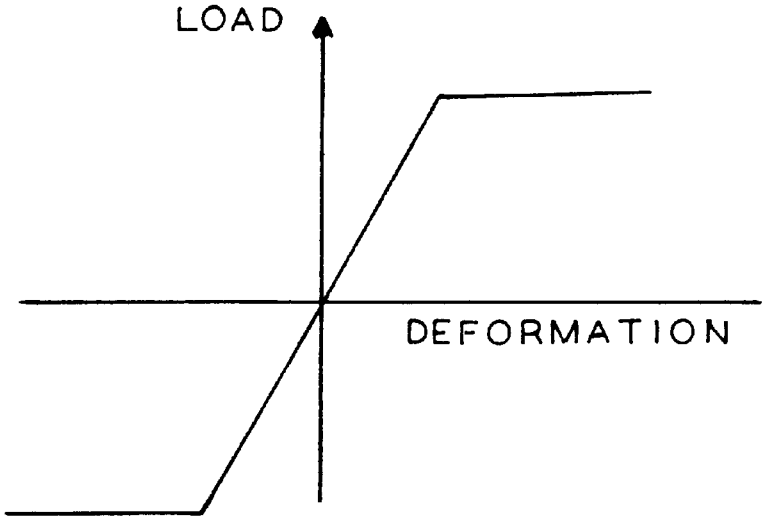
FIGS. 12 and 13 illustrate load and deformation characteristics of compliant elements in connectors.
Figure 13:
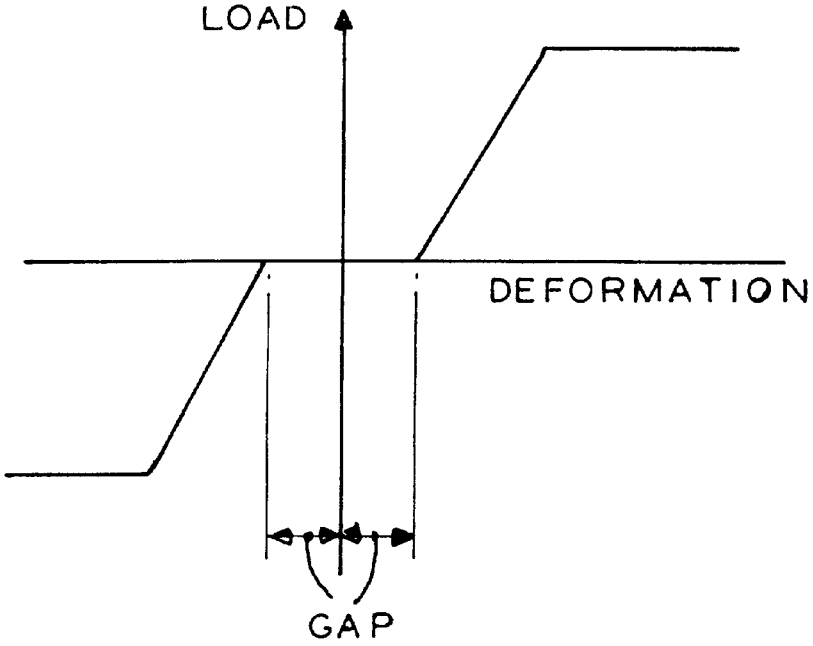

The compliant elements produce the axial load versus deformation relation of the shape shown in FIG. 12. There may be circumstances where the gaps shown in the axial load versus deformation relation of FIG. 13 are also advantageous. The gaps could be fixed or variable depending on requirements.

The invention provides a number of advantages.

The toggle nose and toggle nose receiver are shaped in a way that facilitates docking, i.e., forcing the toggle nose into the toggle nose receiver reduces the relative motion between the floating objects and controls the location well enough to make the connection.

When the toggle mechanism is driven past center against the stop, the transverse pins are locked in the engaged position by a passive system; the stop is not dependent on hydraulic seals or any other hydraulic or mechanical system.

The conical pin ends and the conical socket make it possible to connect while the floating objects are moving relative to each other. The transverse pins have a short distance to move from fully retracted to fully extended. This means that connection and disconnection can be done quickly. The toggle nose and toggle nose receiver are shaped in a way that facilitates separation in higher sea state. The floating objects must move only a short distance, the radius of the toggle nose, in order to be fully separated. FIGS. 7 and 14 illustrate these advantages: It can be seen that the two floating objects only have to move a total distance equal to the radius of the toggle nose 22 to be separated. Thus, the separation can be done quickly and the shape of the toggle nose 22 and its receiver 24 will permit the nose to slide off the receiver without damage.

Figure 14A:
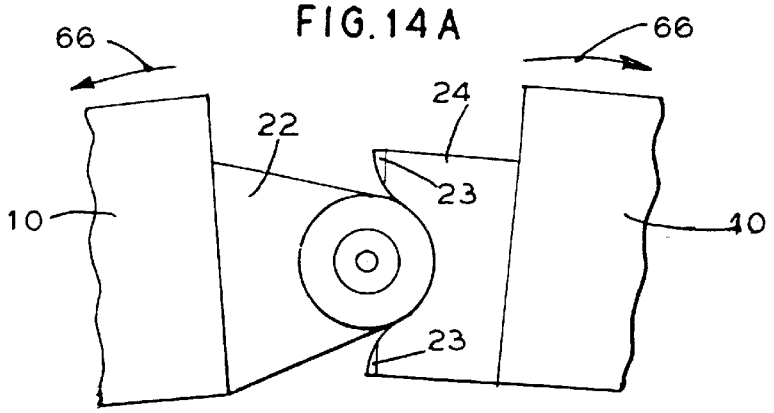
FIGS. 14A–C are vertical sections through a toggle nose seated in a nose receiver.
Figure 14B:
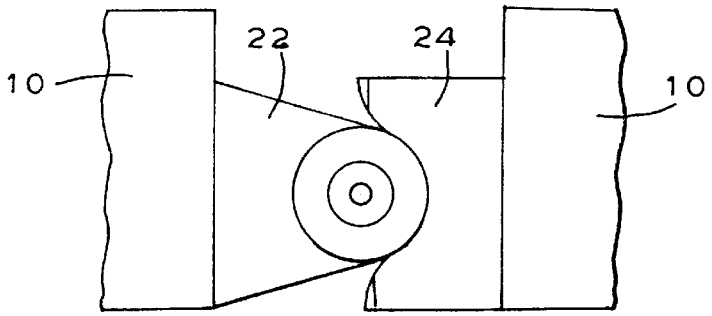
Figure 14C:
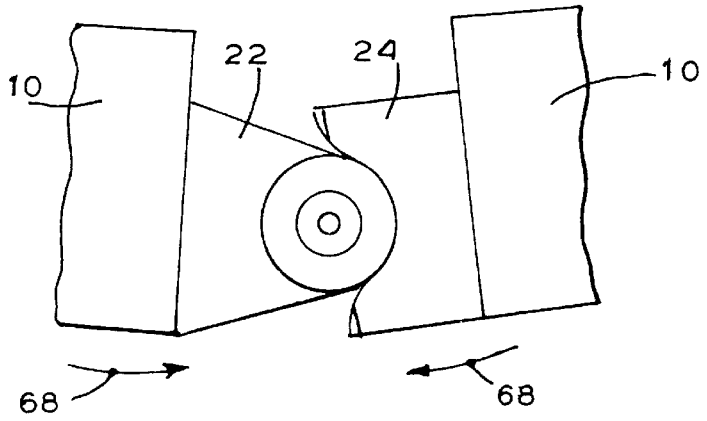

FIGS. 14A–C illustrate the large tolerance for relative pitch of the floating objects 10 when the toggle nose 22 is seated in its receiver 24. FIG. 14A illustrates the nose and receiver bowed up, as indicated by arrows 66. FIG. 14B illustrates the nose and receiver at zero pitch. FIG. 14C illustrates the nose and receiver bowed down, as indicated by arrows 68.

To disconnect, the toggle mechanism must be pushed off the stop past center. Once pushed that far (a few inches at most) the toggle mechanism can be released by the action of the two floating objects separating.

The toggle nose and toggle nose receiver are a fully integrated docking and connection system. The shape of the nose and receiver facilitates docking and separation and supports the toggle mechanism and its opposed transverse pins in the ideal position for making the connection.

Figure 3:
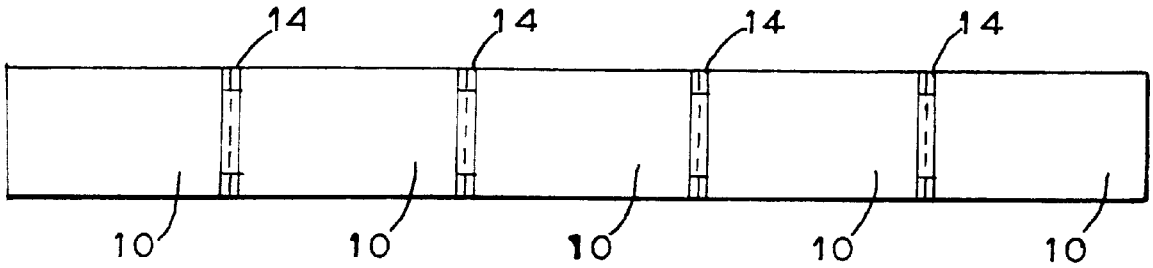
FIG. 3 is a plan view of several floating objects connected together using the connectors of FIG. 2.
Figure 15:
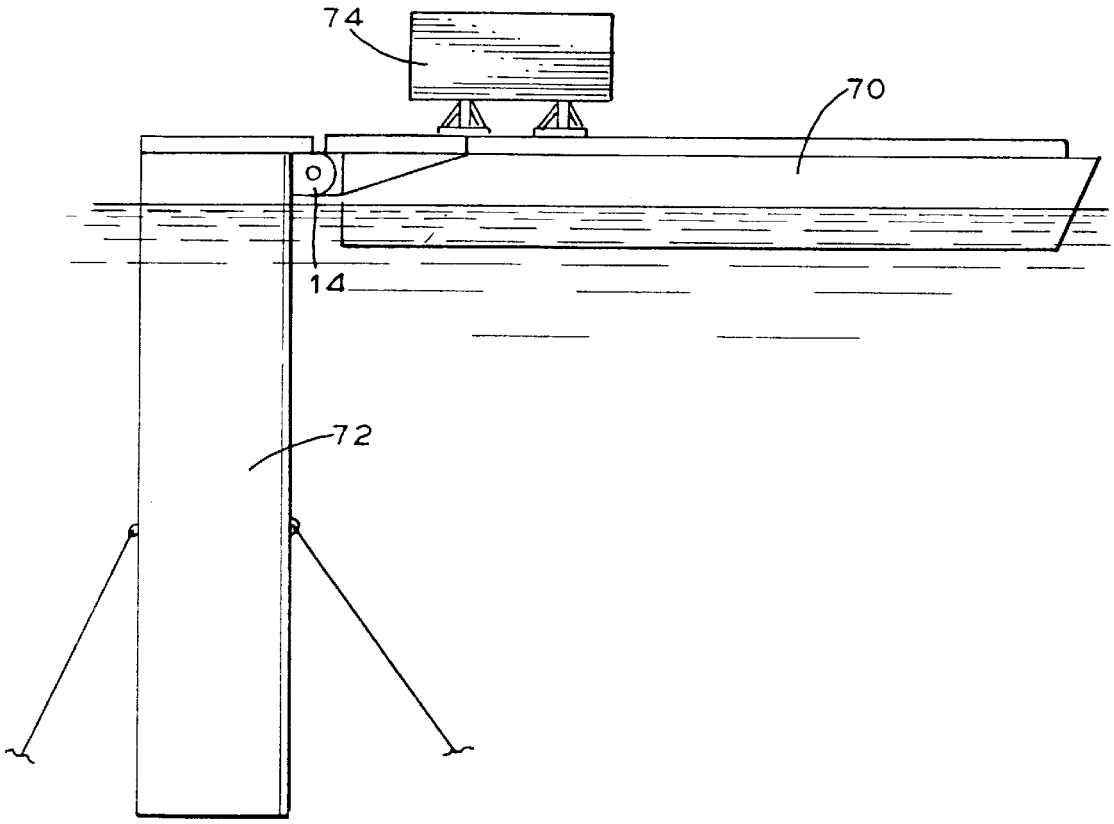
FIG. 15 illustrates one use of the invention.

FIG. 3 illustrates one use of the invention where a number of floating objects 10 are connected end-to-end. This type of arrangement will serve the purpose of a mobile floating airfield or base. FIG. 15 illustrates another use of the invention where a transport barge 70 and offshore structure 72 used to drill for and produce hydrocarbons are connected using the marine connector 14 of the invention. This connection enables a superstructure 74 to be skidded from the transport barge 70 onto the offshore structure 72 without the need for heavy lift crane barges or floatover systems as currently used.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A marine connector, comprising:

a. a toggle nose attached to a first floating object, said toggle nose being oriented in a horizontal plane across a longitudinal axis of the first floating object;

b. a toggle nose receiver attached to a second floating object, said toggle nose receiver being shaped to receive said toggle nose and having sockets provided thereon, with the shape of said receiver preventing vertical movement of said toggle nose within said receiver while allowing relative pitch between said toggle nose and receiver; and c. two opposed pins received in said toggle nose so as to be movable between a first retracted position and a second extended position in contact with the sockets in said toggle nose receiver, said opposed pins being movable in said horizontal plane across the longitudinal axis of the floating objects.

2. The marine connector of claim 1, wherein said toggle nose and toggle nose receiver are provided with complementary beveled and curved shapes.

3. The marine connector of claim 1, further comprising a toggle mechanism for moving said transverse opposed pins between said first and second positions.

4. The marine connector of claim 3, further comprising means for stopping said toggle mechanism at a position slightly beyond center when said transverse opposed pins are in said second extended position.

5. The marine connector of claim 1, wherein said toggle nose receiver is attached to the second floating object by means of a compliant element.

6. The marine connector of claim 1, wherein said transverse pins and sockets in said toggle nose receiver form the only point of contact between said toggle nose and said toggle nose receiver when said transverse pins are in their second extended position and received in the sockets in said toggle nose receiver.

7. A marine connector, comprising:

a. a toggle nose attached to a first floating object, said toggle nose being oriented in a horizontal plane across a longitudinal axis of the first floating object and having a curved leading edge and sides that are beveled outwardly toward the first floating object;

b. a toggle nose receiver attached to a second floating object, said toggle nose receiver having a complementary shape to receive said toggle nose and having sockets provided thereon, with the shape of said receiver preventing vertical movement of said toggle nose within said receiver while allowing relative pitch between said toggle nose and receiver;

c. two opposed pins received in said toggle nose so as to be movable between a first retracted position and a second extended position in contact with the sockets in said toggle noser receiver, said opposed pins being movable in said horizontal plane across the longitudinal axis of the floating objects; and d. a toggle mechanism for moving said transverse opposed pins between said first and second positions.

8. The marine connector of claim 7, further comprising means for stopping said toggle mechanism at a position slightly beyond center when said transverse opposed pins are in said second extended position.

9. The marine connector of claim 7, wherein said toggle nose receiver is attached to the second floating object by means of a compliant element.

10. The marine connector of claim 7, wherein said transverse pins and sockets in said toggle nose receiver form the only point of contact between said toggle nose and said toggle nose receiver when said transverse pins are in their second extended position and received in the sockets in said toggle nose receiver.

11. A marine connector, comprising:

a. a toggle nose attached to a first floating object, said toggle nose being oriented in a horizontal plane across a longitudinal axis of the first floating object and having a curved leading edge and sides that are beveled outwardly toward the first floating object;

b. a toggle nose receiver attached to a second floating object, said toggle nose receiver having a complementary shape to receive said toggle nose and having sockets provided thereon, with the shape of said receiver preventing vertical movement of said toggle nose within said receiver while allowing relative pitch between said toggle nose and receiver;

c. two opposed pins received in said toggle nose so as to be movable between a first retracted position and a second extended position in contact with the sockets in said toggle nose receiver, said opposed pins being movable in said horizontal plane across the longitudinal axis of the floating objects, whereby said transverse pins and sockets in said toggle nose receiver form the only point of contact between said toggle nose and said toggle nose receiver when said transverse pins are in their second extended position and received in the sockets in said toggle nose receives;

d. a toggle mechanism for moving said transverse opposed pins between said first and second positions; and e. means for stopping said toggle mechanism at a position slightly beyond center when said transverse opposed pins are in said second extended position.

12. The marine connector of claim 11, wherein said toggle nose receiver is attached to the second floating object by means of a compliant element.

* * * * *

UNITED STATES PATENT AND TRADEMARK OFFICE

CERTIFICATE OF CORRECTION

PATENT NO. : 5,988,932

DATED : November 23, 1999

INVENTOR(S) : James A. Haney, et al.

It is certified that error appears in the above-identified patent and that said Letters Patent is hereby corrected as shown below:

Column 1, Line 4 Insert "This invention was made with Government support under N00167-95-C-0113 awarded by the Naval Surface Warfare Center. The Government has certain rights in this invention."

Signed and Sealed this

Eighteenth Day of July, 2000

*Attest:*

*Attesting Officer*

Q. TODD DICKINSON

*Director of Patents and Trademarks*